US007025667B1

(12) United States Patent
LaMarche

(10) Patent No.: US 7,025,667 B1
(45) Date of Patent: Apr. 11, 2006

(54) SANDING BLOCK TOOL

(76) Inventor: Paul Emile LaMarche, 1867 Village Green Blvd. (Apt. 202), Rochester Hills, MI (US) 48307

( * ) Notice: Subject to any disclaimer, the term of this patent is extended or adjusted under 35 U.S.C. 154(b) by 0 days.

(21) Appl. No.: 10/971,805

(22) Filed: Oct. 22, 2004

(51) Int. Cl.
*B24B 15/00* (2006.01)

(52) U.S. Cl. ..... 451/523; 451/524; 451/514

(58) Field of Classification Search ..... 451/484, 451/485, 490, 495, 499, 504, 506, 507, 513–515, 451/522–524
See application file for complete search history.

(56) References Cited

U.S. PATENT DOCUMENTS 2,761,257 A * 9/1956 Mendelsohn ..... 451/504
3,106,806 A * 10/1963 Hutchins ..... 451/504
4,730,430 A * 3/1988 Petrovich ..... 451/519
5,383,308 A 1/1995 Beloff et al.
5,720,654 A * 2/1998 Mac Donald ..... 451/523

* cited by examiner

*Primary Examiner*—Dung Van Nguyen
(74) *Attorney, Agent, or Firm*—Steptoe & Johnson, PLLC

(57) ABSTRACT

An apparatus including first and second sections of a sanding block slidably interconnected and adapted for use with a continuous belt, and a resilient member interposed between the first section and second sections such that the resilient member both selectively repels the first and second sections one from the other while securing the first and second sections in a desired position relative to one another. The resilient member is rotatably connected to the first section of the sanding block such that the resilient member moves between alternate rotational positions. The resilient member produces variable pressure on the second section of sanding block depending on the rotational position of the resilient member. The resilient member includes a lever for securing the second section of sanding block in a position relative to the first section of sanding block.

12 Claims, 8 Drawing Sheets

FIG. 2
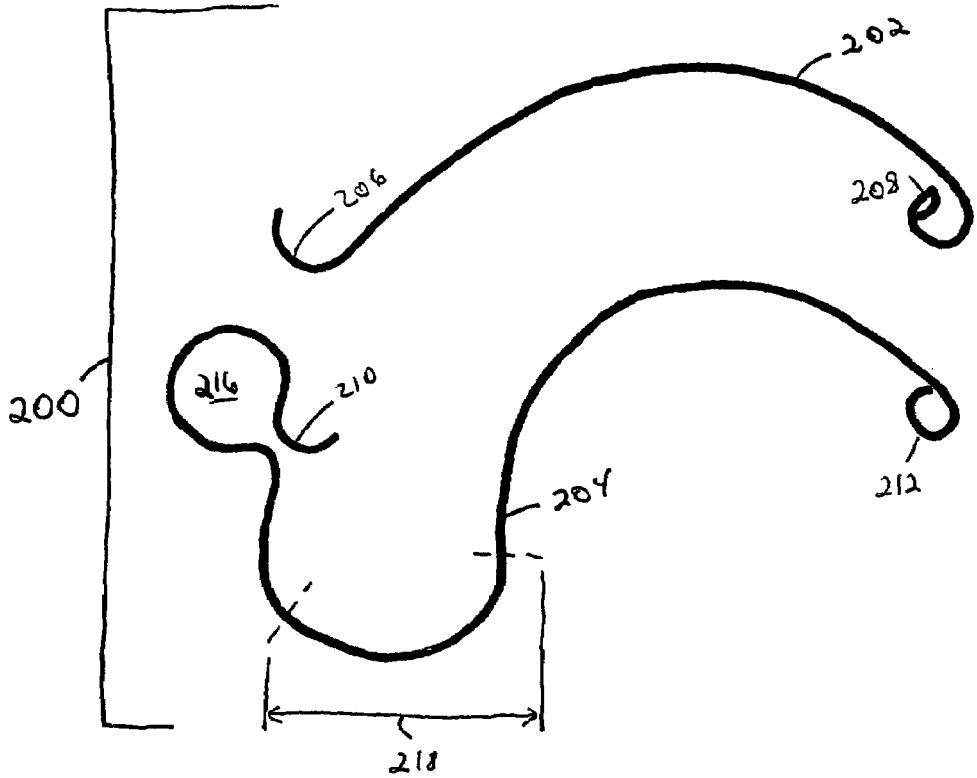
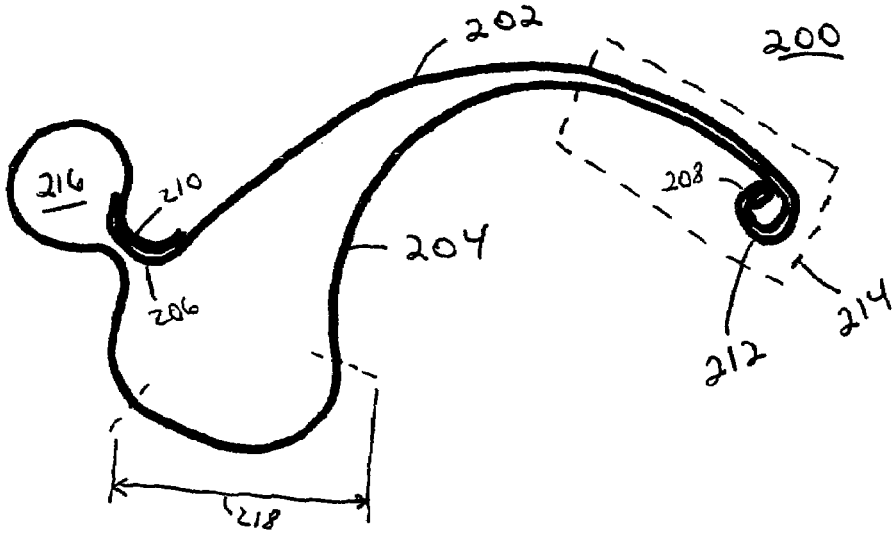
FIG. 3

SANDING BLOCK TOOL

BACKGROUND OF THE INVENTION

1. Field of Invention

This invention relates to an abrading tool, and more particularly, to a continuous loop sanding belt tool being a block having two sections adapted for mounting and removing a continuous sanding belt wherein the two sections are slidable interconnected with a resilient member adapted to push the two sections apart.

2. Related Art

Smoothing and abrading metal and wood surfaces can be accomplished by sanding the surface with an abrasive material such as sandpaper. Sanding can be done either mechanically with a power sander or manually by hand. Manual sanding is made easier and more efficient by using a sanding block in conjunction with a strip or sheet of sanding paper. A sanding block can be anything from a rectangular section of wood, such as a 2×4, to which the sandpaper is secured, to a specially configured block having a curved resilient surface which receives the sandpaper and includes fastening means at the ends of the block for securing the sandpaper to the surface.

In addition to strips or sheets of sanding paper, there also are sanding belt tools having a continuous loop or belt of sanding paper used in conjunction with a tension mounted block for manual sanding. A tension mounted block used in a sanding belt tool typically comprise a pair of blocks with like cross sections which may be of equal or unequal lengths and disposed in coplanar relationship to one another. The two blocks are held in spaced relationship by one or more relatively strong springs. In operation, the blocks are pressed together, thereby compressing the springs, so that the sanding belt is positioned around the blocks. Once in place, the holding pressure on the blocks is released so that the blocks move apart to provide tension to the sanding belt, thereby holding the sanding belt in place around the blocks. This type of tension mounted block usually includes one or more dowel pins on one block that are slidably and removably inserted in corresponding spring locked sockets of the other block. Thus, with this type of tension mounted block, the two blocks are manually pressed or wedged together while at the same time the user must handle the sanding belt for mounting or removal. Since the two blocks are freely movable relative to each other only to a point which will exert the appropriate amount of pressure on the continuous belt surrounding it, any loss of the manual grip on the pressed together blocks before the sanding belt is adequately in place will result in the blocks moving away from each other under the force of the springs—even to the point of complete separation.

One attempt to overcome this separation problem involves a hand sanding block formed from two blocks which are freely movable towards and away from each other, but not to the point of separation. For example, in U.S. Pat. No. 5,383,308 to Beloff, et al., the two blocks are positioned by a pair of spaced dowel pins with springs attached and projecting from one block for telescopic engagement into a corresponding hole of the other component block wherein the two blocks are held apart in spaced relationship by screw secured springs traversely inserted into the end of spiral of the springs. That is, the screws are inserted through the top surface of the sanding block and into the springs to prevent the springs from exiting the block into which they are inserted, thereby preventing the blocks from separating. For mounting and removing the continuous belt, the blocks are pressed together so that the inner ends of the blocks abut. Once the sanding belt is in place around the blocks, the holding pressure is released and the blocks move apart to provide tension on the sanding belt.

While this arrangement, i.e., the screws inserted into the springs, does prevent the blocks from inadvertently separating completely from each other, it is still difficult to mount and remove the continuous sanding belt because the springs must be manually compressed while at the same time manipulating the sanding belt onto the sanding block. Thus, there remains a need in the art for a simple means of mechanically holding the blocks in a compressed position thereby enabling a user to freely mount or remove the continuous sanding belt from around the blocks while eliminating the possibility of the user inadvertently releasing the pressure on the blocks and causing the blocks to separate.

SUMMARY OF THE INVENTION

The present invention solves the foregoing problems by providing a resilient member interposed between first and second sections of a sanding block which both pushes the inner ends of the sections away from each other, while at the same time securing and locking the blocks in a desired position relative to one another.

One aspect of the invention is a sanding tool having first and second sections of a sanding block slidably interconnected and adapted for use with a continuous sanding belt, and a resilient member interposed between the first section and the second section, such that the resilient member both selectively repels the first and second sections from each other, and secures the first and second sections in a desired position relative to one another.

Another aspect of the invention is a method of securing a first section of a sanding block in a position relative to a second section of the sanding block including connecting a resilient member to the first section of sanding block, interconnecting the first and second sections of sanding block, and interposing the resilient member between the first and second sections of sanding block such that the resilient member both repels the first and second sections from each other, and secures the first and second sections of sanding block in a desired position relative to one another.

Another aspect of the invention is an apparatus including a resilient member interposed between first and second sections of a sanding block, such that the resilient member both selectively repels the first and second sections from each other, and secures the first and second sections of sanding block in a desired position relative to one another.

A feature of the invention is a resilient member interposed between the inner ends of first and second sections of a sanding block such that the resilient member both selectively repels the first and second sections from each other, and secures the first and second sections in a desired position relative to one another.

Another feature of the invention is that the resilient member is rotatably connected to a first section of the sanding block such that the resilient member can be placed and locked in alternate rotational positions.

Another feature of the invention is a lever on the resilient member which allows for easy rotation of the resilient member.

An advantage of the invention is that the first and second sections of the sanding block can be positioned and locked relative to one another without the use of dowel rods and springs.

Another advantage of the invention is that the inner ends of the first and second sections can be moved together into an abutting relationship with relatively little effort.

Another advantage of the invention is that it allows for easy mounting and removing of a continuous sanding belt.

Another advantage of the invention is that it does not require one or more screws through the top surface of the sanding block in order to prevent the first and second sections from separating completely.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 2 is a side view of the component pieces of a resilient member of the present invention;

FIG. 3 is a side view of the resilient member;

EMBODIMENTS OF THE INVENTION

Figure 1:
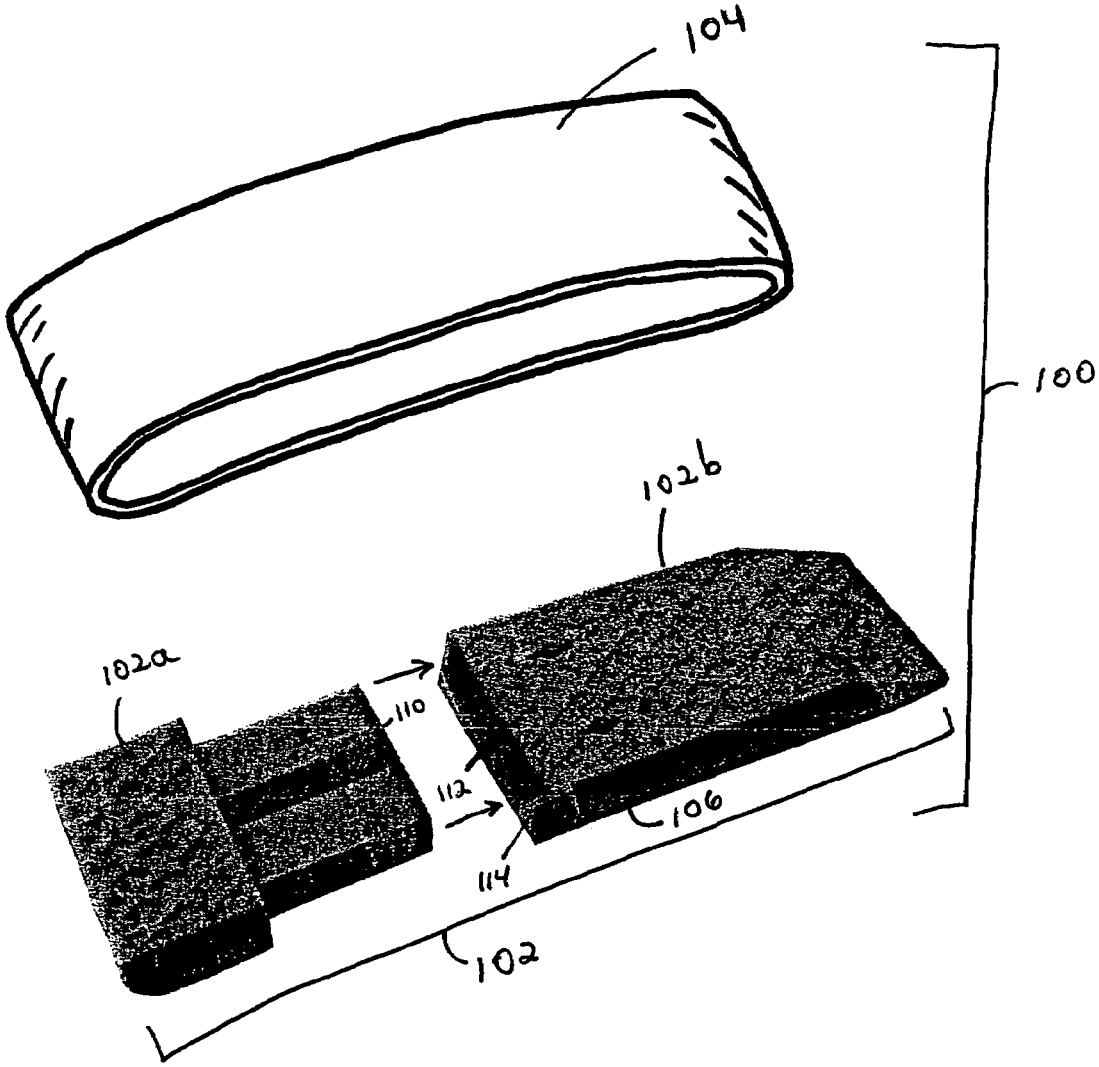
FIG. 1 is a perspective top view of a disassembled sanding block and sanding belt of the present invention.

The components of a sanding block tool 100 of the present invention are shown in FIGS. 1 and 2. The sanding block tool 100 comprises a sanding block 102 for receiving and tensioning a continuous sanding belt 104, e.g., a continuous belt of sandpaper. The preferred sanding block 102 has a first section 102*a* of sanding block 102 and a second section 102*b* of sanding block 102. The first section 102*a* is slidably interconnected within the second section 102*b* by sliding an inner end 110 of the first section 102*a* into a cavity 112 in the inner end 114 of the second section 102*b*. In this embodiment, the first section 102*a* and the second section 102*b* are detachable one from the other as shown in FIG. 1. Alternatively, the sanding block 102 is made such that the first section 102*a* and the second section 102*b*, while having a slidable relationship to each other, remain attached at all times, i.e., are not detachable.

In the preferred embodiment, the second section 102*b* has a flat generally rectangular top surface 108 that has an sloped section 116 that tapers downward. As a result, the sloped section 116 of the second end 102*b* of the sanding block 102 is useful for sanding tight corners and other tough to reach areas. As discussed above, the inner end 114 of the second section 102*b* has a cavity 112 of a predefined size and shape adapted for receiving the inner end 110 of the first section 102*a*. The second section 102*b* optionally but preferably has a length greater than that of the first section 102*a*, such that the second section 102*b* creates a majority of available flat surface area useful for sanding. The sides of the second section 102*b* also are preferably hollowed out, or have a one or more cutouts, to make holding the sanding block 102 easier during use. In addition, the second section 102*b* has a lever aperture 106 through which a lever 214 of a resilient member 200 extends.

Similar to the second section 102*b*, the first section 102*a* also has a flat top surface 108. As discussed above, the length of the top surface 108 of the first section 102*a* is less than the length of the top surface 108 of the second section 102*b*. The distal end of the first section 102*a* is optionally rounded thereby protecting the sanding belt 104 from being cut or damaged during use. The inner end 110 of the first section 102*a* corresponds in size and shape to the cavity 112 in the second section 102*b*. The first section 102*a* and the second section 102*b* thus are slidably interconnected by inserting the inner end 110 of the first section 102*a* into the cavity 112 in the inner end 114 of the second section 102*b*. In so doing, a sanding block 102 having a generally flat, relatively long top sanding surface 108 is created with its distal ends being rounded and narrow, respectively, for sanding in tight areas and protecting the sanding belt 104, and with inner ends 110, 114 that are slidably interconnected. The sides of the first section 102*a*, like those of the second section 102*b*, are hollowed out or contain one or more cutouts to make holding the sanding block 102 easier during use.

In the preferred embodiment, the sanding block tool 100 also comprises a means for exerting outward pressure on the first section 102*a* and the second section 102*b* of the sanding block 102. Thus, when the sanding belt 104 is disposed around the sanding block 102, the first section 102*a* is repelled from the second section 102*b* such that the sanding belt 104 is held in place around the sanding block 102 by the outward pressure exerted by the first section 102*a* and the second section 102*b*. Preferably, a resilient member 200 is positioned within the cavity of the second section 102*b* for forcing the inner ends 110, 114 of the first and second sections 102*a,b* away from one another and for securing the relative positions of the first and second sections 102*a,b* of the sanding block 102.

As shown in FIG. 2, a resilient member 200 of the present invention is preferably made of a first half piece 202 and a second half piece 204 which are interlocked to form a single component—the resilient member 200. The first half piece 202 has a curved first end 206 and a looped second end 208. Likewise, the second half piece 204 has a circular first end terminating in a curved portion 210 and a looped second end 212. The second half piece 204 also has a connecting loop 216 for securing the resilient member 200 within the second section 102*b* of the sanding block 102 and has a pressure portion 218 for contacting and moving the first section 102*a* of the sanding block 102. To interconnect the ends of the first half piece 202 and a second half piece 204, the curved first end 206 of the first half piece 202 corresponds and aligns with the shape of the curved portion 210 of the circular first end of the second half piece 204. Thus, the curved first end 206 of the first half piece 202 is placed in contact with the outer curved surface of the curved portion 210 of the circular first end of the second half piece 204. Then the looped second end 208 of the first half piece 202 is bent toward and put in contact around the looped second end 212 of the second half piece 204 such that the looped second end 212 of the second half piece 204 is contained with the looped second end 208 of the first half piece 202. Once the two halves 202, 204 are interconnected, the alignment of the second ends of the pieces forms a lever 214 on the resilient member 200 which is used to rotated the resilient member 200 as described herein for securing the first section 102*a* of the sanding block 102 in a position relative to the second section 102*b* of the sanding block 102.

Figure 4:
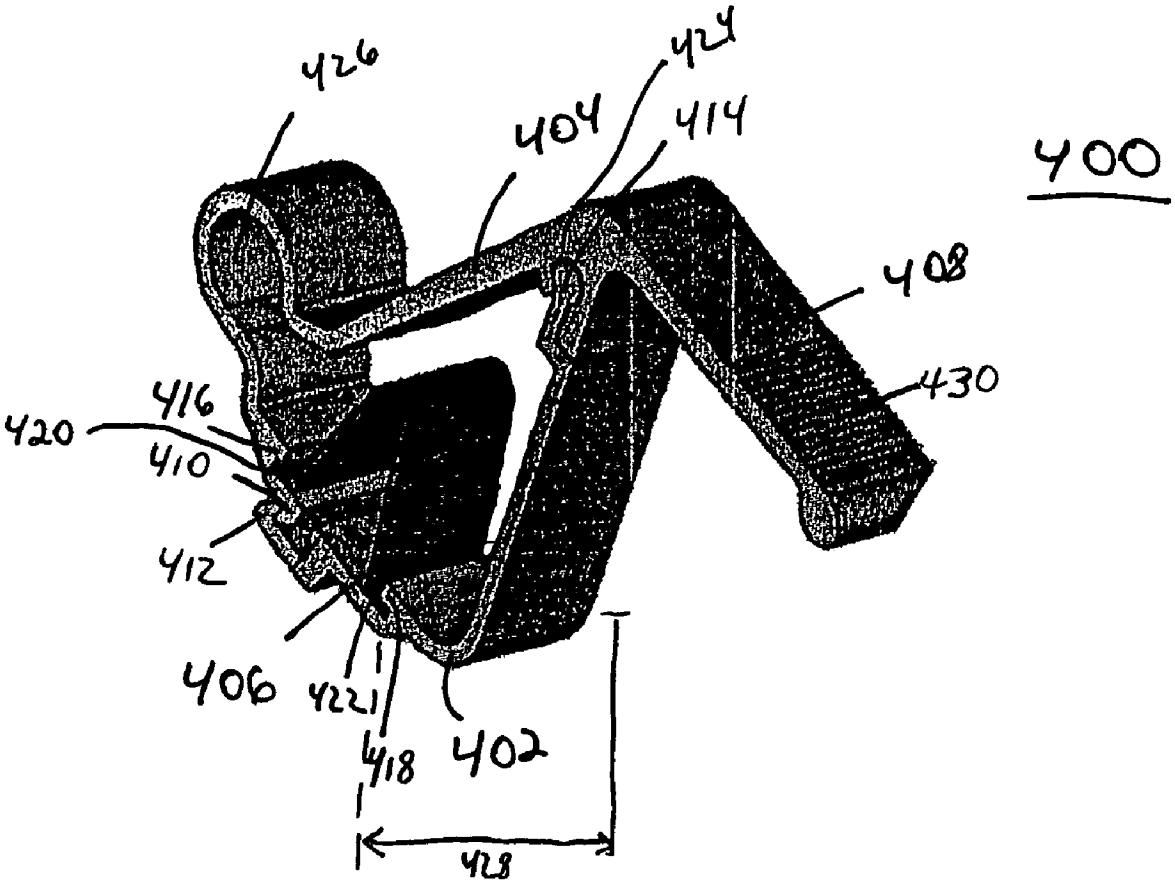
FIG. 4 is a perspective side view of an alternative resilient member of the present invention.

The use of a resilient member 200 as shown in FIGS. 2 and 3 is for convenience purpose only. An alternative embodiment of a resilient member 400 is shown in FIG. 4. In this embodiment, a first half piece 402 is interconnected with a second half piece 404 and such interconnection is supported by a supporting piece 406. Specifically, the first half piece 402 has a first end 414 that terminates at a ball which locks into a socket 424 of the second piece 404, and has a second end 412 that fits within a first flange 410 of the second half piece 404. The first half piece 402 also has a connecting loop 426 for securing the resilient member 400 within the second section 102*b* of the sanding block 102, as well as a pressure portion 428 for contacting and moving the first section 102*a* of the sanding block 102. The second half piece 404 also has a lever 408 extending therefrom, with optional grooves 430 on the top surface for improving a user's grip on the lever 408. The lever 408 is used to rotated the resilient member 400 as described herein for securing the first section 102*a* of the sanding block 102 in a position relative to the second section 102*b* of the sanding block 102.

The supporting piece 406 is Y-shaped having a first flange 420 and a second flange 422 at its ends. The supporting piece 406 secures the first half piece 402 and the second half piece 404 by inserting the first flange 420 of the supporting piece 406 under a supporting flange 416 of the interior of the second half piece 404 and inserting the second flange 422 of the supporting piece 406 under a supporting flange 418 of the first half piece 402. The supporting piece 406 is made of a flexible, but resilient, material, e.g., metal, having an inherent spring or elasticity due in part to the Y-shape of the supporting piece 406. Therefore, in constructing the resilient member 400, a user first inserts the ball end 414 of the first half piece 402 into the socket 424 of the second half piece 404 while sliding the second end 412 of the first half piece 402 into the first flange 410 of the second half piece 404. Once the pieces are connected, the user applies pressure to the sides of the supporting piece 406 bring the first flange 420 and the second flange 422 closer together, then positions the first flange 420 under the supporting flange 416 of the second half piece 404 and the second flange 422 under the supporting flange 418 of the first half piece 402. Once in proper position, the pressure on the supporting piece 406 is released thereby locking the supporting piece 406 in place and further securing the first half piece 402 to the second half piece 404.

As shown in FIGS. 5–8, a resilient member, such as resilient member 200, is secured within the cavity 112 of the second section 102*b* of the sanding block 102 via the connecting loop 216. In the preferred embodiment, the connecting loop 216 is placed over a protrusion 704 on the bottom surface of the second section 102*b* of the sanding block 102. Thus, the resilient member 200 freely rotates or pivots about the protrusion 704. Furthermore, the resilient member 200 is positioned within the second section of the sanding block 102 with the lever 214 extending through the lever aperture 106 so that it is easily accessible by the user.

Figure 8:
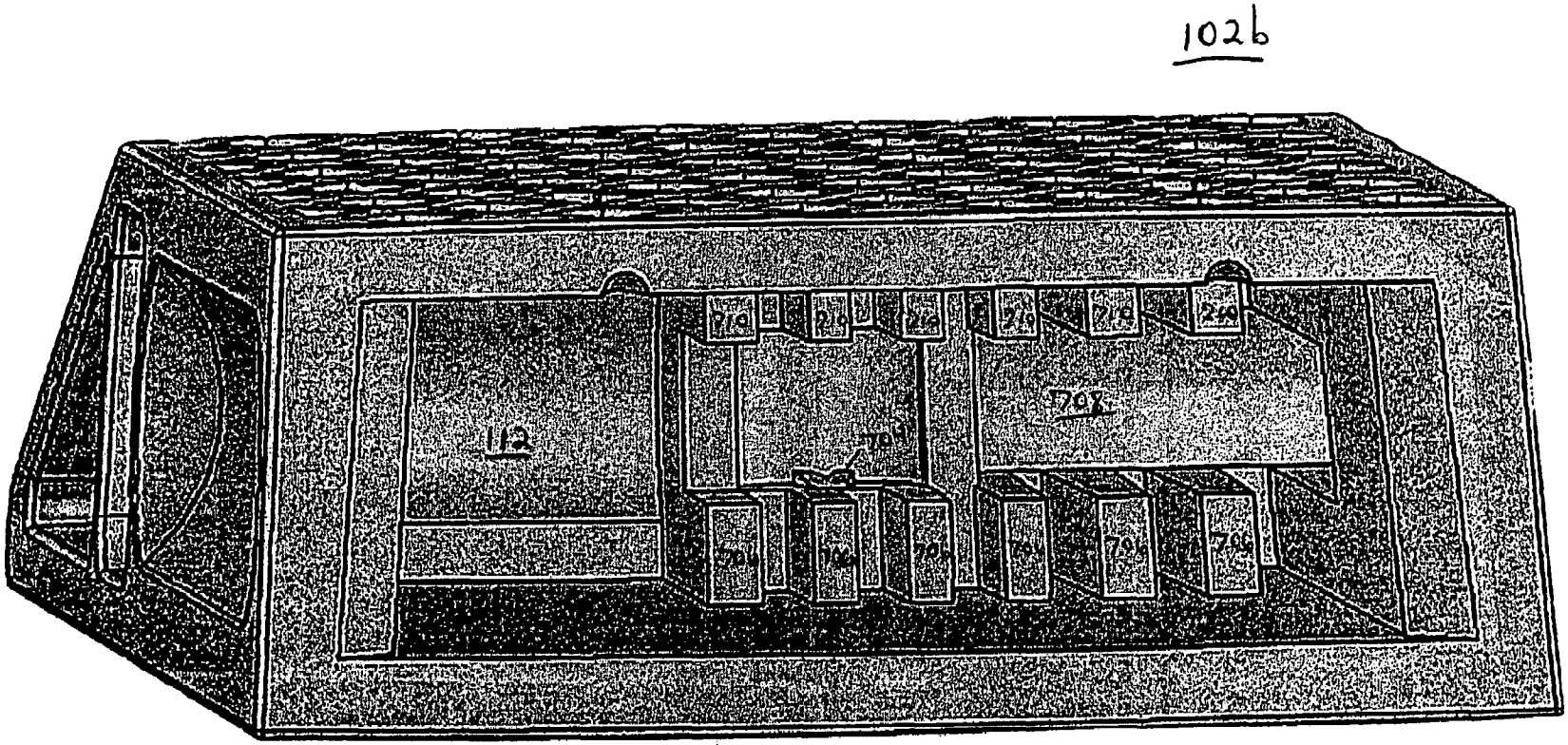
FIG. 8 is a perspective front view of a second portion of a sanding block.

FIG. 8 is a perspective front view of the inner end 114 of the second section 102*b* showing the cavity 112 and the protrusion 704 on which the connecting loop 216 of a resilient member 200 is placed in order for the resilient member 200 to rotate. Also, for convenience purpose only, the preferred embodiment of the second section 102*b* includes a groove 708 within a back wall of the cavity 112, the groove 708 having a height of a size adapted to accommodate the resilient member 200. In the preferred embodiment, the groove 708 is made plurality of bottom flanges 706 and top flanges 710.

Figure 5:
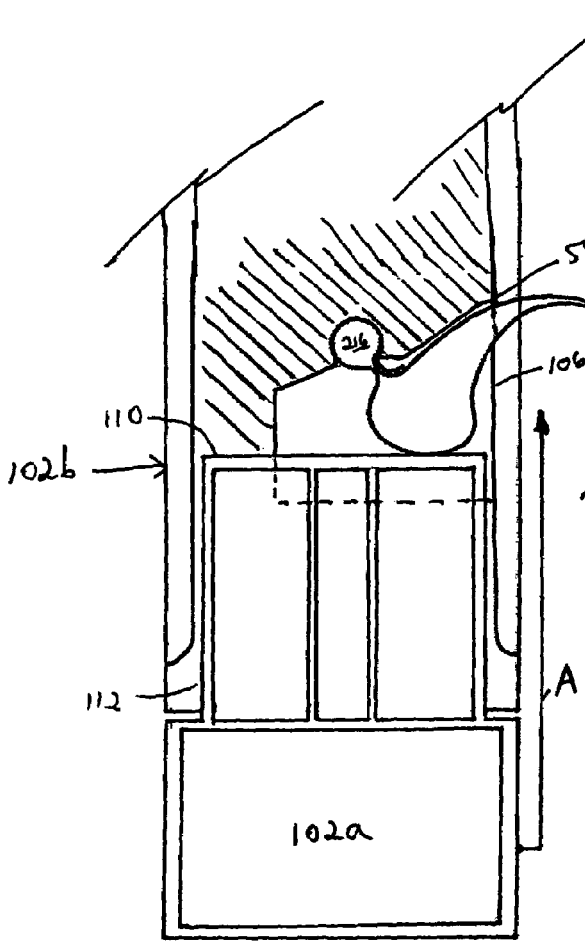
FIG. 5 is a planar top view of the interior of an assembled sanding block with a resilient member in a released position.

FIG. 5 shows the internal operation of the present invention with the resilient member 200 being in a released position. That is, the resilient member 200 is positioned within the cavity 112 of the second section 102*b* with the lever 214 against the back edge 502 of the lever aperture 106. In this released position, the first section 102*a* freely moves in direction A such that the first section 102*a* is retracted a maximum distance within the cavity 112 of the second section.

Figure 6:
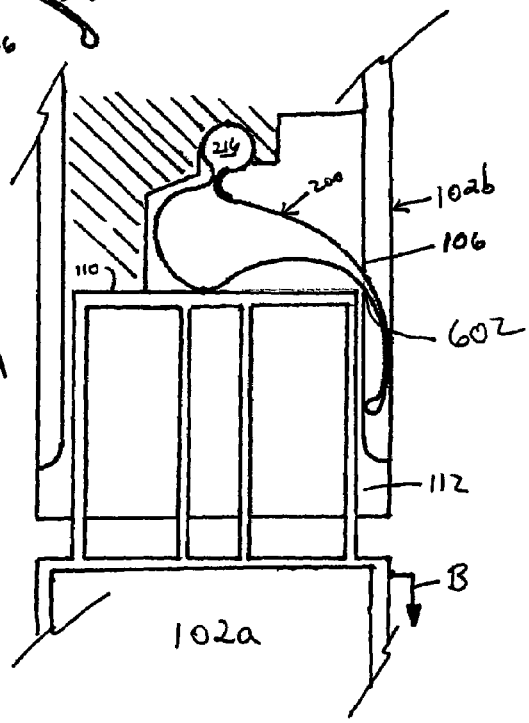
FIG. 6 is a planar top view of the interior of an assembled sanding block with a resilient member in an engaged position.
Figure 7:
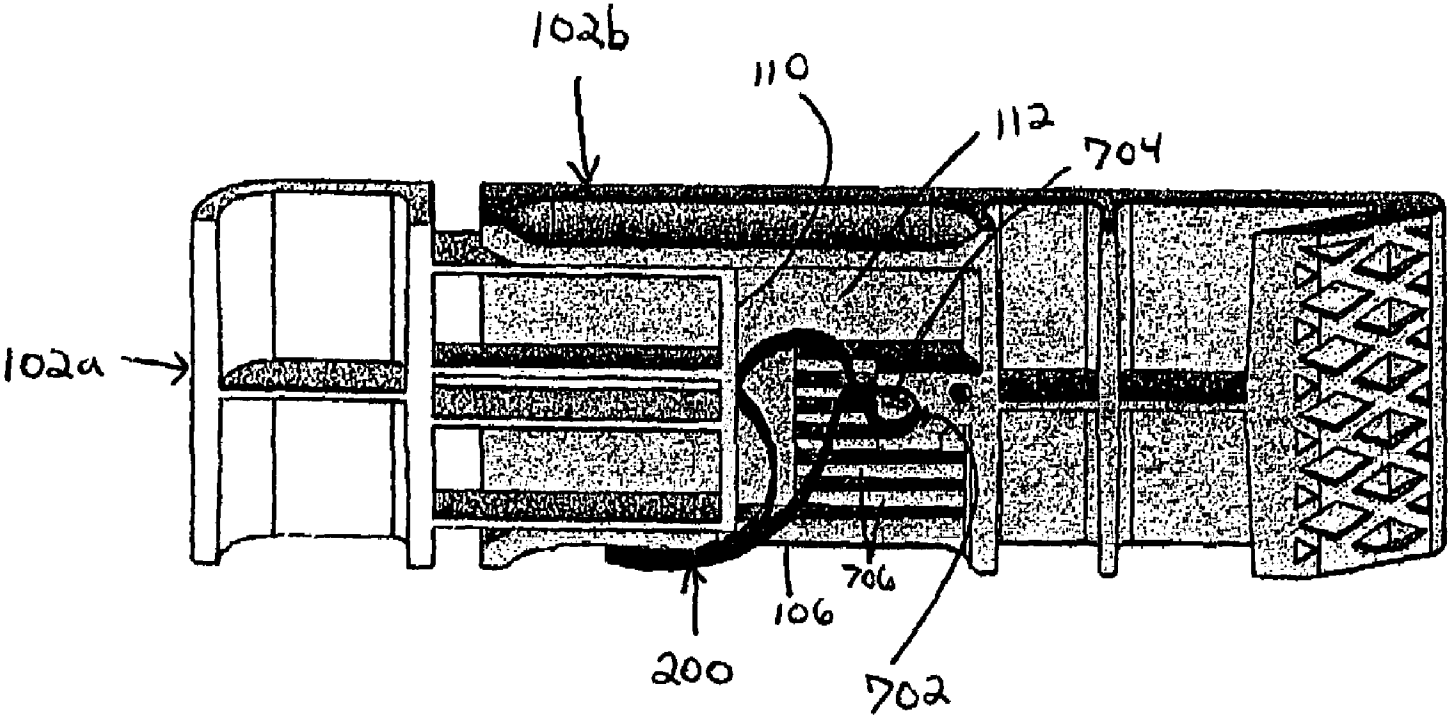
FIG. 7 is a perspective top view of an interior of an assembled sanding block with a resilient member in an engaged position.

Then, as shown in FIGS. 6 and 7, as the user moves the lever 214 of the resilient member 200 forward, until the lever 214 contacts the front edge 602 of the lever aperture 106, the resilient member 200 rotates about the protrusion 704 causing the pressure portion 218 of the resilient member 200 to rotate against and apply an inward force against the inner end 110 of the first portion 102*a*, thereby pushing the first portion 102*a* forward in direction B and placing the resilient member 200 into an engaged position. Once the lever 216 contacts the front edge 602, the resilient member 200 is secured or locked in this position due to the inherent characteristics of the resilient member 200. That is, the resilient member 200 cannot be pushed automatically to its original released position, as shown in FIG. 5, because the concave shape of the resilient member 200 and the position of the pressure portion 218 render the resilient member 200 immobile until the user moves the lever 216 to the back edge 502 which causes the rotation of the resilient member 200 about the protrusion 704.

Figure 9:
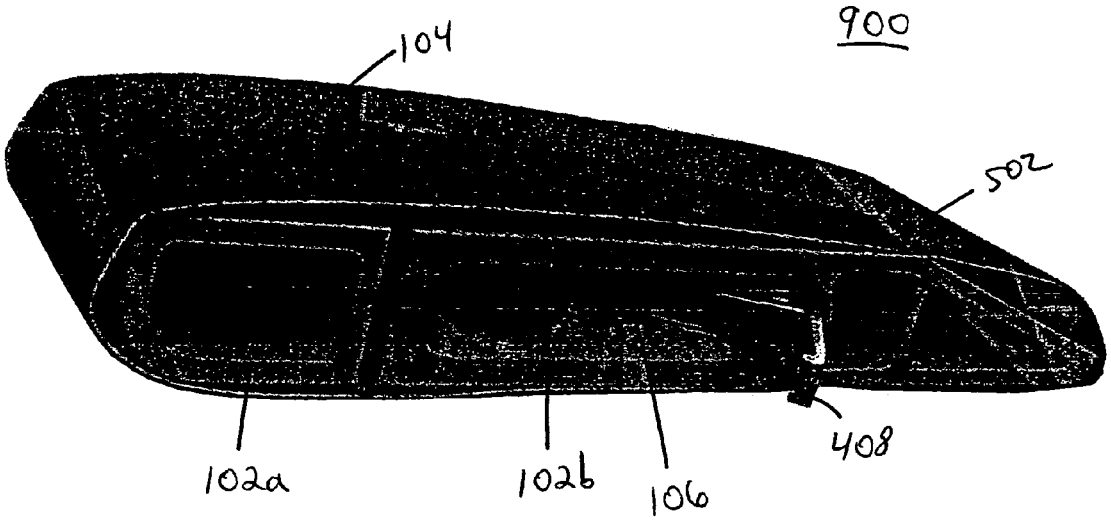
FIG. 9 is a perspective side view of a sanding block tool of the present invention in a released position.
Figure 10:
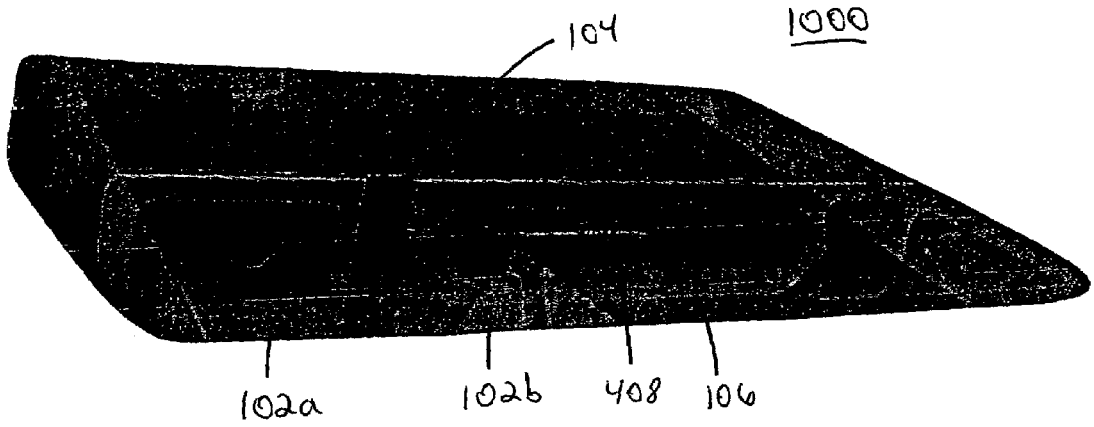
FIG. 10 is a perspective side view of the sanding block tool of the present invention in an engaged position.

FIGS. 9 and 10 show the complete sanding block tool 900, 1000, respectively, of the present invention wherein the sanding block 102 is disposed within the sanding belt 104. As seen in FIG. 9, the lever 408 of the resilient member 400 is against the back edge 502 of the lever aperture 106, thereby placing the resilient member 400 in the released position. The released position allows the first section 102*a* to move freely within the cavity 112 of the second section 102*b*, which in turn causes slack in the sanding belt 104 around the sanding block 102.

In FIG. 10, the lever 408 of the resilient member 400 is pulled forward to the front edge 602 such that the resilient member 400 is rotated into the engaged position. The engaged position results in the pressure portion 428 of the resilient member 400 to rotate against and apply an inward force against the inner end 110 of the first portion 102*a*, thereby pushing the first portion 102*a* forward until it removes the slack from the sanding belt 104 and the sanding belt 104 is tight against the outer surface of the sanding block 102.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention. Thus, the breadth and scope of the invention should not be limited by any of the above-described exemplary embodiments.

What is claimed is:

1. A sanding block tool, comprising:

a sanding block having a first section and a second section slidably interconnected and adapted for use with a continuous sanding belt; and a resilient member interposed between said first section and said second section, such that said resilient member both selectively repels said first section from said second section one from the other and secures said first section and said second section in a desired position relative to one another, wherein said resilient member is rotatably connected to said first section of said sanding block such that said resilient member rotates between alternate rotational positions.

2. The sanding block tool of claim 1, wherein said resilient member produces variable pressure on said second section of said sanding block depending on the rotational position of said resilient member.

3. The sanding block tool of claim 1, wherein said resilient member comprises a lever extending from said sanding block for securing said second section of said sanding block in a position relative to said first section of said sanding block.

4. The sanding block tool of claim 3, wherein said lever exerts pressure against a side of said second section of said sanding block when said resilient member is in an engaged position, thereby securing said first section and said second section of said sanding block in a desired position relative to one another such that said sanding block engages said sanding belt.

5. The sanding block tool of claim 4, wherein the pressure exerted by said lever against a side of said second section of said sanding block is released when said resilient member is moved from said engaged position to a released position, thereby releasing said sanding block from engaging said sanding belt.

6. The sanding block tool of claim 1, wherein said resilient member has an eccentric shape such that it produces variable pressure on said second section of said sanding block depending on the rotational position of said resilient member.

7. A method of securing a first section of a sanding block in a position relative to a second section of the sanding block, comprising:

(a) connecting a resilient member to a first section of a sanding block;

(b) interconnecting said first section of said sanding block to a second section of said sanding block such that said second section of said sanding block abuts said resilient member; and (c) interposing said resilient member between said first section and said second section of said sanding block such that said resilient member both repels said first section and said second section of said sanding block from each other and secures said first section and said second section of said sanding block in a desired position relative to one another, wherein said resilient member is rotatably connected to said first section of said sanding block such that said resilient member rotates between alternate rotational positions.

8. The method of claim 7, wherein said resilient member produces variable pressure on said second section of said sanding block depending on the rotational position of said resilient member.

9. The method of claim 7, wherein said resilient member comprises a lever extending through said first section for securing said second section of said sanding block in a position relative to said first section of sanding block.

10. The method of claim 9, wherein said lever exerts pressure against a side of said second section of said sanding block when said resilient member is in an engaged position, thereby securing said first section and said second section of said sanding block in a desired position relative to one another.

11. The method of claim 10, wherein pressure exerted by said lever against a side of said second section of said sanding block is released when said resilient member is moved from said engaged position to a released position.

12. The method of claim 7, wherein said resilient member has an eccentric shape such that it produces variable pressure on said second section of said sanding block depending on the rotational position of said resilient member.

* * * * *